United States Patent [19]

Summa

[11] Patent Number: 4,790,247

[45] Date of Patent: Dec. 13, 1988

[54] TROLLEY STOP FOR POWER AND FREE CONVEYORS

[75] Inventor: Gareth D. Summa, Riverside, Mo.

[73] Assignee: MidWest Conveyor Company, Inc., Kansas City, Kans.

[21] Appl. No.: 926,672

[22] Filed: Nov. 4, 1986

[51] Int. Cl.[4] ..... B61B 13/00; B61K 7/02

[52] U.S. Cl. ..... 104/172.2; 104/172.3; 104/250; 104/252

[58] Field of Search ..... 104/172.1, 172.2, 172.3, 104/172.4, 249, 250, 252, 253

[56] References Cited

U.S. PATENT DOCUMENTS

| | | | |
|---|---|---|---|
| 2,496,916 | 2/1950 | Kershaw | 104/252 |
| 3,130,685 | 4/1964 | Goodrich et al. | 104/172.2 |
| 3,195,474 | 7/1965 | Dehne | 104/172.4 |
| 3,418,946 | 12/1968 | Yokoi et al. . | |
| 3,437,054 | 4/1969 | Bishop | 104/178 |
| 3,451,352 | 6/1969 | Curry et al. | 104/172 |
| 3,477,390 | 11/1969 | Dolding . | |
| 3,503,337 | 3/1970 | Haase | 104/172 |
| 3,523,504 | 8/1970 | Jones | 104/172 |
| 3,559,585 | 2/1971 | Lempio | 104/172 |
| 3,774,546 | 11/1973 | Krammer . | |
| 3,831,528 | 8/1974 | Redlichs | 104/172 R |
| 3,934,516 | 1/1976 | Paglia . | |
| 4,644,869 | 2/1987 | Rhodes | 104/172.2 |

FOREIGN PATENT DOCUMENTS

| | | | |
|---|---|---|---|
| 1090577 | 10/1960 | Fed. Rep. of Germany | 104/252 |
| 1170986 | 5/1964 | Fed. Rep. of Germany | 104/250 |
| 2132502 | 1/1973 | Fed. Rep. of Germany | 104/172.4 |

*Primary Examiner*—Robert B. Reeves
*Assistant Examiner*—Frank H. Williams, Jr.
*Attorney, Agent, or Firm*—Litman, McMahon & Brown

[57] ABSTRACT

A trolley stop assembly is provided for use with an inverted power and free conveyor system having a trolley member driven along a track. A depending trolley dog is engaged by drive dogs on a drive mechanism for pushing the trolley along the track and is movable between upper and lower positions for disengagement and engagement with the drive dogs. The assembly includes a stop arm pivotally mounted within the conveyor system for pivoting about a horizontal axis. Provisions are made for lifting the stop arm into an upper position to engage a portion of a trolley dog on a trolley to be stopped to lift the trolley dog out of possible engagement with the drive dogs. The stop arm includes an upper cam surface with an abutment portion for braking the trolley by mating with a portion of the trolley dog. An actuator mechansim includes a cam engageable with the stop arm to pivot same between upper and lower positions. The cam member is actuated by a piston and cylinder arrangement positioned on a side of the assembly. Provisions are made for retaining the stop arm in an upper position without maintaining pressure in the cylinder.

8 Claims, 2 Drawing Sheets

TROLLEY STOP FOR POWER AND FREE CONVEYORS

BACKGROUND OF THE INVENTION

The present invention relates to conveyors and, in particular, to power and free conveyors. Specifically, the invention relates to trolley stop assemblies which are used to disengage trolleys from a dive system, stopping the trolley at selected places along a conveyor track. The trolley stop assembly of the instant invention is particularly developed for use with otherwise conventional inverted power and free trolley systems.

Conventional power and free trolley conveyors are characterized by a transport mechanism which includes a trolley mounted on rollers or the like for movement along a track or rail system. Generally, such trolleys have a member extending therefrom which is engaged by a dog member on a drive, such as a chain drive or similar drive, to convey momentum to the trolley. In a power and free system, the trolleys may sometimes roll along the tracks freely, even when the dog member on the drive does not engage the trolley. For example, the trolley may be allowed to freely roll during a downhill slope, when going around a curve, or when being transferred between chain drives. Further, disengagement between the trolley and the drive dog may be desired at points when the trolley is to be stopped, as for example when maintenance, construction, or repair access to an object being transferred by the trolley is desired.

Generally, in such systems a carrier member is mounted upon the trolley. The carrier member may vary considerably, depending on the nature of the objects to be transported. It will be understood that a variety of carrier members may be used in association with the present invention.

For conventional systems, the term "inverted" as in "inverted power and free conveyors" refers to the fact that the drive mechanism which engages the extending member on the trolley, generally runs beneath the track and the trolley. In many conventional systems, the drive mechanism comprises a continuous chain drive with upwardly extending drive dogs thereon. The drive dogs for inverted systems engage a depending member on the trolley to push same. Herein, the extending member on the trolley will be referred to as the trolley dog and the dog on the drive system as a drive dog or pusher dog.

In many conventional systems the trolley dog is vertically movable between upper and lower positions. When in the lower or engaged position, the trolley dog depends low enough to be engaged by pusher dogs being driven underneath the trolley by means of the drive mechanism. On the other hand, when the trolley dog is in the upper or disengaged position, it is generally too high to be reached by the upwardly extending drive or pusher dogs. Therefore, when the trolley dog is in the upper position, the trolley is not positively engaged and driven.

Many conventional trolley stops operate by selectively moving the trolley dog between engaged and disengaged positions. Generally, for such systems, the trolley dog has a forward cam surface which, when it engages the trolley stop, is cammed upwardly until disengagement with the drive dog is achieved. Typical conventional trolley systems operate by providing, selectively, an obstruction in the path-of-motion of the trolley to cause the camming of the trolley dog to an orientation out of engagement with the pusher dog.

For example, a conventional trolley stop arrangement may utilize a knife blade extending perpendicular to the track of the trolley, sometimes extending completely thereacross, to be engaged by the trolley dog. The knife blade, when withdrawn, does not block the path-of-motion of the trolley dog, and thus the trolley will pass the trolley stop under positive drive. On the other hand, when the blade is extended into the path of the trolley dog, it will be engaged thereby, with the camming action lifting the trolley dog and bringing the trolley to a stop.

Such conventional trolley stops, while they have been somewhat effective, have not been completely satisfactory. First, such knife blade arrangements often require portions which extend outwardly from the side of the track or conveyor body. That is, often a piston for operating the knife blade, a linkage system, or a receptacle for receiving the knife blade, when retracted, extends substantially outward from the side of the track. This not only takes up space which might be more conveniently used, but also provides inconvenient and potentially hazardous obstructions to vehicles or personnel moving closely along the side of the conveyor track.

Further, such systems have not, in the past, satisfactorily provided for positive braking of the trolley. That is, a primary reason that the trolley comes to a stop is that the trolley dog has become disengaged from the drive dog. Further, the friction of the trolley dog rubbing against the knife blade does tend to bring the trolley to a stop. However, generally satisfactory positive braking is not achieved with such a system.

OBJECTS OF THE INVENTION

Therefore, the objects of the present invention are: to provide a trolley stop assembly especially suited for use with power and free trolley conveyor systems; to provide such a trolley stop assembly potentially utilizable with either overhead or inverted power and free systems; to provide such a trolley stop assembly characterized by a stop arm pivotally mounted therein to move between braking and non-braking positions to selectively engage a trolley, stopping same; to provide such a stop arm which is elongate in configuration and which has an upper cam surface, the upper cam surface being engageable with a trolley dog on a selected trolley to cam same out of engagement with an associated drive dog and stop the trolley; to provide such an assembly having such a stop arm which is pivotally mounted about a generally horizontal axis that extends generally perpendicular to a path-of-motion of trolleys along the track; to provide such a stop arm in which the stop arm upper cam surface includes an abutment portion matable with a portion of the trolley dog to positively engage same during braking of the trolley, aiding in braking; to provide such a trolley stop assembly having an actuator mechanism for selectively actuating the stop arm; to provide a trolley stop assembly wherein the actuator mechanism includes a cam member pivotably mounted within the assembly for engagement with the stop arm, the cam member engaging the stop arm in such a manner so that when the cam member is in a first position the stop arm is engaged and pressed into a position for engagement with the trolley dog, to stop the trolley; to provide such an assembly wherein the cam member is further selectively positionable into a second position, whereby the stop arm is biased out of possible stopping contact with the trolley dog; to provide such an assembly wherein the cam member is selectively operated by means of a piston and cylinder arrangement; to provide such an assembly wherein the stop arm and cam member are positionable, in an inverted power and free system, beneath trolley members and generally above the system's drive mechanism; to provide such an assembly wherein neither the trolley stop arm nor the cam member extends substantially completely across a path-of-movement of the trolley; to provide such an assembly wherein both the stop arm and the cam member are mounted for pivoting about substantially horizontal axes; to provide such an assembly wherein the cam member is elongate and includes a first end and the stop arm includes a lower cam surface with a rest portion therein; to provide such an assembly wherein, during operation to stop a moving trolley, the stop arm is supported in a first stop arm position by means of the elongate cam member first end being received against the stop arm lower cam surface rest portion; to provide such an assembly wherein engagement between the cam member first end and stop arm rest portion is such that the stop arm is supported in the first position without positive retention therein by means of the associated piston and cylinder assembly used to actuate the cam member, that is, wherein the forces of gravity generally maintain the engagement; to provide such a system which is relatively inexpensive to produce and assemble; and to provide such an assembly which is relatively easy to manufacture, simple to use and which is particularly well adapted to the proposed usages thereof.

Other objects and advantages of this invention will become apparent from the following descriptions taken in connection with the accompany drawings, wherein are set forth by way of illustration examples of certain embodiments of this invention.

SUMMARY OF THE INVENTION

A trolley stop assembly is provided for use with power and free trolley conveyor systems. In general operation, the trolley stop assembly provides means for disengagement of moving trolleys from a drive mechanism and further for positively stopping the trolley at a preferred location along a track.

It will be readily understood that the instant invention may be adapted for use with either overhead power and free conveyor systems or inverted power and free conveyor systems. However, herein the invention will be described in a preferred embodiment for application with inverted power and free systems.

Generally, in a conventional inverted power and free trolley system, a trolley mounted upon wheels or the like moves along a path-of-motion defined by a track positioned in a warehouse, assembly plant or the like. Generally, the term "power and free" refers to the fact that the trolley may be positively driven over certain portions of the track but may freely roll over others. For example, the trolley may be allowed to freely roll when it is going downhill, around a curve, or when it is being passed from one drive mechanism to another.

Generally, the term "inverted" refers to the fact that the trolley is positioned underneath objects which are being transported and above the positive drive mechanism for the trolley system. Generally, the trolley includes means such as a carrier member mounted thereon for engagement with objects to be transported. Further, the trolley includes means, generally referred to as a trolley dog, extending therefrom which may be engaged by the positive drive mechanism to push the trolley along the track. In an inverted system, generally the trolley dog depends from, or extends downwardly from, the trolley.

In many conventional inverted power and free trolley conveyors, the positive drive mechanism comprises a plurality of movable drive or pusher dogs positioned for movement along a path parallel with and underneath the track. Generally, the drive dogs are elongate and extend upwardly for potential engagement with a trolley dog. Upon engagement with a trolley dog, the pusher dogs, which are themselves positively driven, will push the trolley along the track. Often the pusher dogs are driven by a continuous chain drive or the like positioned underneath the trolley and the track.

In inverted power and free systems, conventional trolley dogs are often vertically movable between upper and lower positions. When in the lower extending or depending position, the trolley dog is oriented for potential engagement by drive dogs on the drive mechanism. On the other hand, when the trolley dog is biased into the upper or retracted position, it is preferably raised too high for potential engagement with the drive dogs. Thus, when the trolley dog is in the upper position the trolley is free of the drive mechanism, i.e., the trolley is not positively driven.

The instant invention provides an alternative to conventional systems for selectively biasing a selected trolley dog between the depending and non-depending positions in order to selectively stop the trolley at preferred locations along the track. In general, the invention comprises the provision of means which may be selectively oriented in a position to be engaged by a moving trolley dog, lifting same out of engagement with a positive drive. The invention particularly comprises the provision of an alternative to knife blade mechanisms which may extend across the track and require projections extending outwardly from the side of the track. The instant invention comprises the utilization of a stop arm mounted generally underneath the track for pivotal motion about a generally horizontal axis. For the most part, with such a system potentially bothersome projections extending outwardly from a side of the conveyor track are minimized.

The preferred stop assembly according to the instant invention includes a frame member mounted generally underneath the trolley track. The stop arm is mounted upon the frame member for pivoting about a generally horizontal axis directed perpendicular to the track or path-of-motion of the trolleys.

The preferred stop arm is generally elongate, includes an upper cam surface, and is pivotable between a first position and a second position. When in the first position for an inverted power and free system, the stop arm extends generally upwardly and diagonally along a path-of-motion for the trolleys. In the first position, the stop arm upper cam surface is oriented such that it will be engaged by a trolley dog on the next trolley moving along the track, forcing the trolley dog generally upwardly. As will be understood from the detailed descriptions, the shape and extension of the stop arm when in the first position is such that the trolley dog will be sufficiently biased upwardly to result in disengagement with an associated drive dog on the drive mechanism. Thus, the stop arm, when in the first position, selectively stops the trolley from moving along the track.

The preferred stop arm according to the present invention includes an abutment portion therein which is matable with a front edge portion of the trolley dog to provide for selective positive braking when the trolley dog is in the upper position. Generally, the abutment portion of the stop arm includes an edge which projects substantially upwardly when the stop arm is in the first position the edge of the stop arm abutment portion, again, mating with a similar edge in the trolley dog. Thus, the stop arm abutment portion operates by providing an obstruction to further movement of the trolley, positively braking same.

Actuation means are provided for selectively generating movement of the stop arm between the first position and a second position wherein the stop arm is out of orientation for engagement with the trolley dogs. Thus, if the actuation means or mechanism is operated to bias the stop arm into the second position, trolleys moving along the track are not stopped.

In the preferred embodiment, the actuator mechanism includes a cam member also pivotably mounted upon the frame member for pivoting about a horizontal axis extending generally across the trolley track. The cam member in the preferred embodiment is oriented generally underneath the stop arm and, when pivoted, may selectively bias the stop arm between the first and the second positions. The preferred cam member comprises an elongate arm having a first end which is positioned generally for selected abutment with a lower cam surface on the stop arm. When the cam member is pivoted to extend with the first end oriented generally upwardly, the stop arm is pushed upward and into the first position. On the other hand, when the cam member is pivoted to extend generally horizontally or downwardly, the stop arm is released from the first position and is allowed to pivot downwardly and out of potential contact with the trolley dogs.

In the preferred embodiment, the cam member is actuated by means of a double-action piston and cylinder arrangement which engages a pivot axle of the cam member by means of a bell crank or the like. Such a system provides for a generally low profile and does not require extensive mechanical members projecting substantially outwardly from the conveyor track or the side of the conveyor.

In the preferred embodiment means are provided to retain, when desired, the stop arm in the first position without requiring positive pressure in the piston and cylinder arrangement to prevent pivoting. Generally this is done by providing a rest portion in a lower cam surface of the stop arm the rest portion being generally horizontal when the stop arm is in the first position. The rest portion is oriented with respect to the cam member for engagement therewith when the cam member is in the first position. Preferably, the engagement is such that when the cam member is in the first position, it extends generally straight upwardly as a finger. The stop arm rest portion is engaged by the upper end of the cam member, generally resting thereon. Thus, gravity provides the engagement between the stop arm and the cam member, and the substantial vertical extension of the cam member prevents its pivoting. As will be understood by reference to the detailed description, under these basic circumstances positive pressure does not have to be retained against pivoting of the cam member to maintain same in position.

The drawings constitute a part of this specification and include exemplary embodiments of the present invention, to illustrate various objects and features thereof. In some instances material thicknesses may be shown exaggerated, for clarity.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather merely as a basis for the claims and as a representative basis for teaching one skilled in the art to employ the present invention in virtually any appropriately detailed structure.

Figure 1:
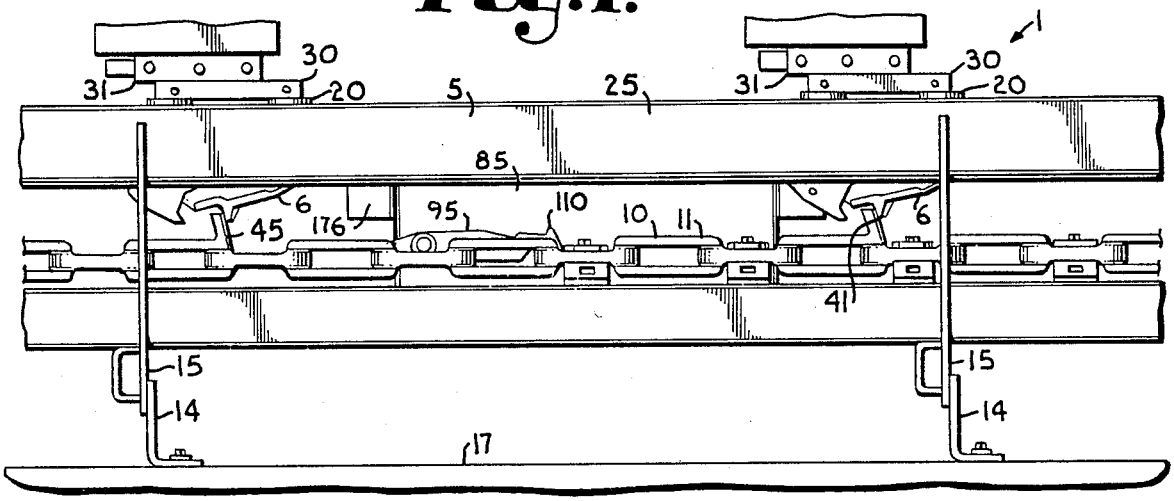
FIG. 1 is a fragmentary side elevational view of an inverted power and free trolley conveyor system shown in operation with a trolley dog engaged by a drive or pusher dog on a continuous chain drive, the conveyor system incorporating a trolley stop assembly according to the present invention.

The reference numeral 1, FIG. 1, generally designates a conveyor system incorporating a trolley stop assembly according to the present invention. FIG. 1 generally comprises a fragmentary side elevational view of a conveyor system 1, including a track 5 in which trolleys 6 ride, the track 5 defining a path-of-motion for the trolleys about a warehouse, assembly plant, or the like. The trolleys 6 for the system shown are powered by a drive mechanism 10 preferably comprising a continuous chain drive 11 described in further detail below.

Referring again to FIG. 1, the conveyor system 1 includes supports 14 which generally engage frame members 15 to ultimately support the track 5, trolleys 6, and drive mechanism 10 above the floor 17 of the workplace in a conventional manner. A variety of support means may be utilized in association with the present invention.

Figure 2:
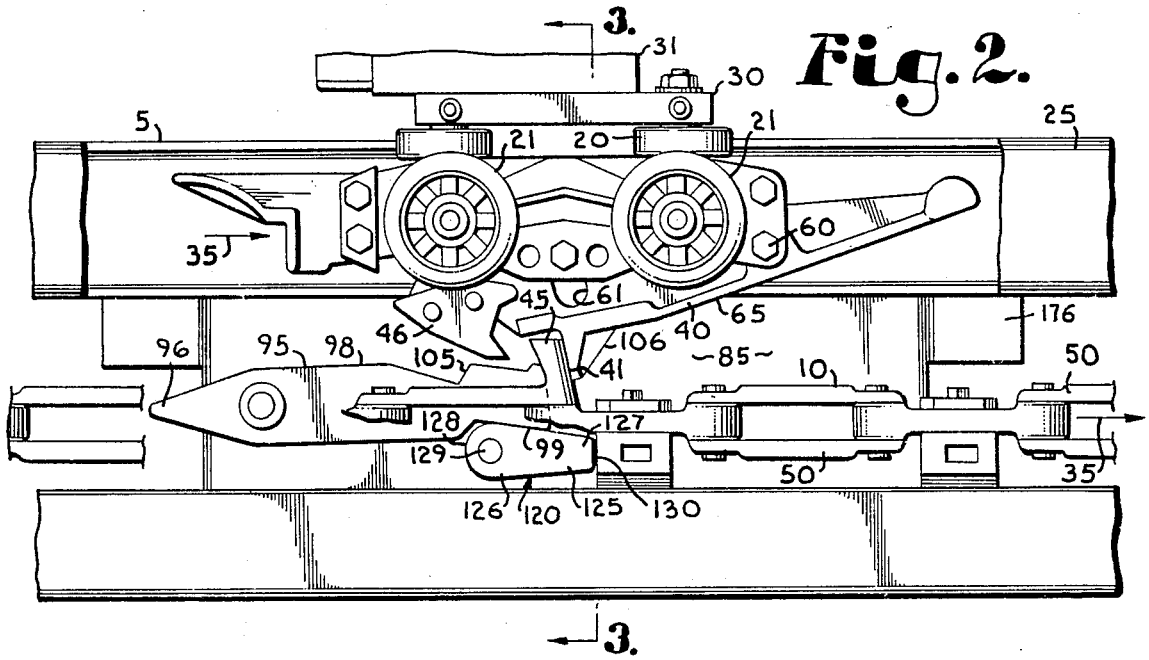
FIG. 2 is an enlarged, fragmentary side elevational view of a portion of the apparatus shown in FIG. 1, from basically the same perspective and with portions broken away to show internal detail.
Figure 3:
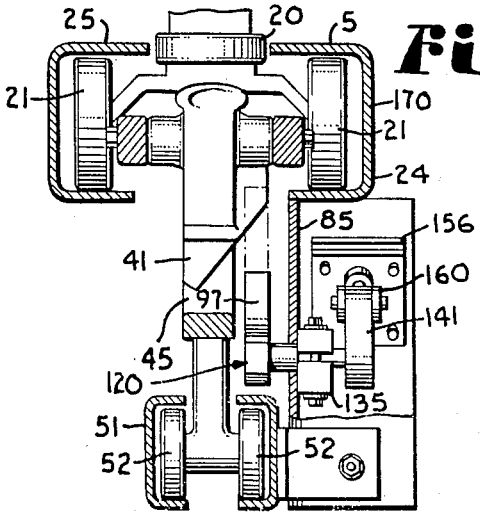
FIG. 3 is an enlarged, fragmentary cross-sectional view taken generally along line 3—3 of FIG. 2.

Referring to FIGS. 1, 2, and 3, each trolley 6 includes a truck 20 mounted upon a plurality of rollers 21 and may be of a conventional design. Generally, the rollers 21 are positioned within the track 5 to transport the truck 20 therealong. In FIG. 3, the track 5 is shown comprising first and second C-shaped halves 24 and 25 which face one another and receive the rollers 21 therein, a conventional arrangement.

As is conventional for inverted power and free trolley conveyor systems, each trolley 6 includes an upper portion 30 adapted to carry whatever objects are to be transported by the conveyor. Details concerning this are not shown, as any of a variety of systems may be utilized in association with the present invention. In FIG. 1, the upper portion 30 of each trolley 6 is shown adapted to support a carrier member 31 used to engage objects to be transported.

Referring to FIG. 2, in a conventional manner movement of the trolley 6 in normal operation of the system 1 is conventional manner, the trolley 6 includes a trolley dog 40 extending therefrom, the trolley dog 40 being engageable by the drive mechanism 10. In particular, the trolley dog 40 includes an extension 41 thereon which, for the inverted system, projects downwardly and is engageable by the drive mechanism 10.

In a conventional manner, the drive mechanism 10 comprises a continuous chain drive 11 having drive or pusher dogs 45 mounted thereon. The drive dogs 45, FIGS. 2 and 3, comprise fingers which extend generally upwardly from the chain drive 11 a sufficient amount to engage downward extensions 41 on the trolley dogs 40. Thus, as the chain is driven in the direction of arrows 35, the drive dogs 45 are driven in the same direction and, eventually, encounter the trolley dogs 40 at the downward extension 41. When this occurs the trolley 6 is pushed along the track 5 in a conventional manner.

Referring to FIG. 2, the trolley 6 includes a rear latch member or backup dog 46 thereon which, in a conventional manner, can slide in behind the drive dogs 45 to prevent the trolley 6 from being able to roll forward and out of engagement with the drive dogs 45 of the drive mechanism 10. Latch mechanisms such as mechanism 46 are well-known in the art.

Referring to FIGS. 2 and 3, generally the continuous chain drive 11 shown comprises a plurality of chain links 50 guided along lower track 51 by means of rollers 52 in a conventional manner. A power means, not shown, such as an electric motor can be used to drive the chain.

Figure 5:
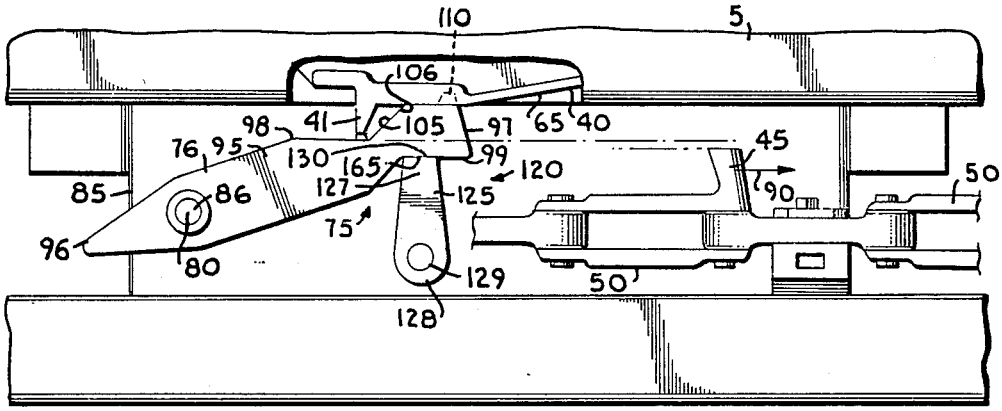
FIG. 5 is an enlarged, fragmentary side elevational view of a portion of the apparatus shown in FIG. 2, but with portions broken away to show internal detail and with the stop assembly of the instant invention oriented in engagement with a trolley dog to stop same from engagement with a drive dog on a drive mechanism.

Referring to FIGS. 2 and 5, also in a conventional manner, the trolley dog 40 is pivotally mounted on the trolley 6. Generally, the trolley dog 40 can be moved between: a first position, FIG. 2, wherein it is engageable by drive dogs 45 and a second position, FIG. 5, wherein it is out of position for engagement by drive dogs 45. In particular, the first position of FIG. 2 is a lower depending position for the trolley dog 40. However, in FIG. 5 the trolley dog 40 has been pivoted upwardly somewhat to a position generally above the extent of reach of the drive dogs 45. Referring to FIG. 2, generally pivoting may be about pivot point 60, facilitated in part by slot 61.

By comparison of FIGS. 2 and 5 it will be readily understood that, in order to stop motion of the trolley 6 along the track 5, generally what is required is a selected pivoting of the trolley dog 40 from the lower position, FIG. 2, to the upper position of FIG. 5. Conventional trolley stop arrangements have been developed to accomplish this; however, the trolley stop assembly according to the instant invention provides a new and advantageous alternative.

Generally, the trolley dogs, such as dog 40, each include a forward cam edge 65 which extends generally forwardly and upwardly from the downward extension 41. The instant trolley stop arrangement operates by providing an obstruction in the path-of-motion of the trolley 6, such that the obstruction will be engaged by the forward cam edge 65 to force the forward cam edge 65 to pivot upwardly and lift the downward extension 41 above the drive dogs 45. Conventional trolley stop assemblies sometimes operate by providing a knife blade that projects horizontally across the track, when actuated, to obstruct and lift a trolley dog.

Figure 6:
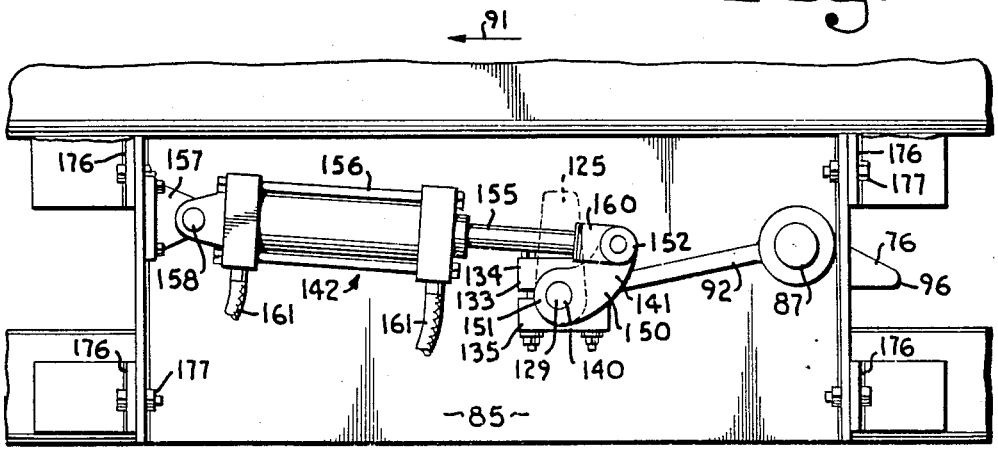
FIG. 6 is an enlarged, fragmentary side elevational view taken generally from an opposite side of the conveyor assembly as that of FIG. 5, and with phantom lines indicating the position of a portion of an apparatus out of view on an opposite side of a frame or wall member.

Referring to FIG. 5, the instant invention comprises the provision of a trolley stop assembly 75 including a stop arm 76 pivotally mounted in the assembly 75 for movement about a substantially horizontal pivot axis 80. Specifically, the trolley stop assembly 75 includes a frame member 85 which, for the preferred embodiment, comprises a vertical sheet of metal or the like positioned generally beneath one side of the trolley track 5. The stop arm 76 is mounted upon the frame member 85 by means of an axle 86 and bearing system 87, FIGS. 5 and 6. FIGS. 5 and 6, it will be understood, generally represent views taken from opposite sides of the assembly 75. Forward motion of the chain drive is represented in FIG. 5 by arrow 90 and in FIG. 6 by arrow 91. Gusset 92 attached to frame member 85, by welding or the like, provides strength in support of the axle 86 and bearing arrangement 87, FIGS. 4 and 6.

The stop arm 76 generally comprises an elongate arm 95 having a first end 96, a second end 97, a first or upper cam edge or surface 98 and a second or lower cam edge or surface 99. The stop arm 76 is mounted upon the axle 86 and bearing arrangement 87 at a point substantially adjacent the first stop arm end 96. It is noted that pivoting about axis 80 can be provided either by a pivotal relationship between the arm 75 and the axle 86, or by providing a pivotal relationship between the axle 86 and the frame member 85. In the preferred embodiment, FIGS. 4 and 5, the arm 75 is rigidly mounted upon the axle 86 which is rotatably mounted within the system by the bearing assembly 87.

In the preferred embodiment, FIGS. 1 through 7, the stop arm 76 is pivotable back and forth between a first braking position FIG. 5 and a second non-braking position FIG. 2. Generally, pivoting between the two positions for the preferred embodiment requires a relatively small amount of pivoting about pivot axis 80. For an embodiment involving an inverted power and free system, the first braking position involves an upward extension of the stop arm 76; and the second non-braking position involves a generally lower extension of the arm 76, in FIG. 2 a generally horizontal extension.

Referring to FIG. 5, when the arm 76 is in the first upper or braking position, the upper cam surface 98 is oriented to engage the forward cam surface 65 of a trolley dog 40 on a passing trolley 6. In FIG. 5 an engaged trolley dog 40 is shown having been lifted by riding up along the upper cam surface 98 of the stop arm 76. As a result, trolley dog 40 has been lifted out of possible engagement with drive dogs 45. The net result is that the trolley 6, engaged by the stop arm 76, will come to a stop.

Means are provided to ensure a relatively positive braking engagement between the stop arm 76 and the trolley dog 40 when the trolley dog 40 has been lifted into the upper braking position. In particular, referring to FIGS. 2 and 5, the preferred upper cam surface 98 of the stop arm 76 includes an abutment portion 105 therein. The abutment portion 105 of the stop arm 76 is appropriately shaped to engage and mate with abutment portion 106 on the trolley dog forward cam surface 65, FIG. 5, when the trolley dog 40 has been upwardly pushed into a preferred position for braking. It will be readily understood by reference to FIG. 5 that once the abutment portions 105 and 106 engage or mate with one another, the trolley 6 will come to an abrupt stop. This results, in part, from a general upward, and especially a substantially vertical, extension of edge 105 on the stop arm 76 when the stop arm is in the first, generally upwardly directed, position, FIG. 5. It is further assisted by the provision of an upwardly extending knob 110 on a tip of the abutment portion 105.

The stop arm 76 described is preferable over many knife blade arrangements for braking trolleys for numerous reasons including the fact that the stop arm 76 does not extend completely across the track 5. Further, a more positive braking relationship may be provided by the abutment portion 105. Also, the stop arm 76 can be actuated by means which do not project substantially outwardly from a side of the track 5. This will become apparent from the following descriptions:

Actuator means are provided to generally bias the stop arm 76 back and forth between the extreme positions represented by FIGS. 2 and 5. The preferred actuator means comprises an actuator mechanism 120 including a cam member 125 FIGS. 2, 5 and 6. The preferred cam member 125, of the embodiment described comprises an elongate finger 126 having a first end 127 and a second end 128, FIG. 2. In the preferred embodiment the cam member 125 is pivotally mounted upon the frame member 85 by means of axle 129. Preferably, engagement between the cam member 125 and the axle 129 is non-pivoting; that is, as the axle rotates by means of bearing assembly 133, FIGS. 4 and 6, the cam member 125 is pivoted. Also, preferably pivoting takes place about a pivot axis 136 which extends generally parallel to pivot axis 80, FIG. 4. The cam member 125 is mounted upon the axle 129 at a point substantially adjacent its second end 128.

Referring to FIGS. 2 and 5, the cam member 125 is preferably oriented and sized so that, as it is pivoted, it operably engages the lower cam edge or surface 99 of the stop arm 76. Thus, pivoting of the cam member 125 results in biasing the stop arm 76 upwardly, FIG. 5, and reverse pivoting permits the stop arm 76 to be lowered, FIG. 2. The preferred cam member 125 generally tapers inwardly as it extends toward its first end 127 to provide an appropriate cam surface for interaction with the stop arm 76. The end 127 is provided with a flat surface 130 (FIG. 2) for stable engagement with the stop arm 76.

Figure 4:
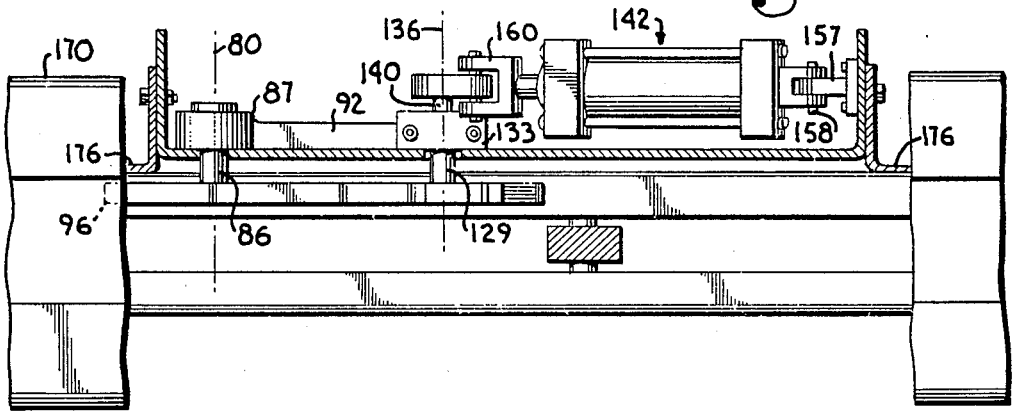
FIG. 4 is an enlarged fragmentary top plan view of a portion of the apparatus shown in FIG. 1, with portions broken away to show detail.

Referring to FIG. 6, the axle 129 is mounted in and rotates with respect to bearing assembly 133, the bearing assembly including pillow blocks 134 and 135 for support. The actuator mechanism 120 for the stop arm 76 further includes means for selective generation of pivoting of the cam member 125 to selectively operate the trolley stop assembly 75. Referring to FIGS. 4 and 6, an end 140 of the axle 129 includes a crank arm 141 mounted thereon. As the crank arm 141 is pivoted by means of a piston and cylinder arrangement 142, the cam member 125 is operated.

Referring to FIG. 6, the crank arm 141 of the preferred embodiment comprises a curved member 150 having a first end 151 and a second end 152. The crank arm 141 is mounted upon axle 129 by means of the first end 151, FIG. 6. It is noted that in the preferred embodiment the crank arm 141 is mounted upon the axle 129 on a side of the frame member 85 opposite the cam member 125. Thus, in FIG. 6 the cam member 125 is shown in phantom lines.

Still referring to FIG. 6, in the preferred embodiment the piston and cylinder arrangement 142 comprises a doubleaction piston 155 and cylinder 156. The cylinder 156 is mounted pivotally by means of ear 157 and axle 158. The piston 155, in the conventional manner, includes a first end 160 which pivotally engages the second end 152 of the crank arm 141. A pair of fluid lines 161 provide fluid power during either extension or retraction to the piston and cylinder arrangement 142 by means of a conventional power assembly, not shown. It will be understood that either pneumatic or hydraulic systems may be utilized in cooperation with the present invention. Further, other methods of rotating the cam 125 may be employed.

Figure 7:
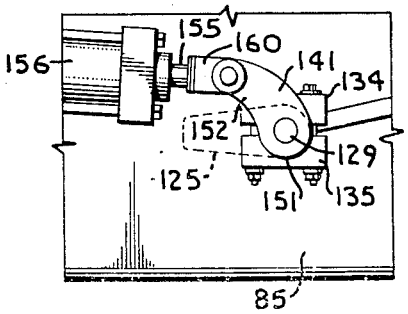
FIG. 7 is an enlarged, fragmentary side elevational view taken generally from a position analogous to that shown in FIG. 6, but with a portion of the apparatus shown in an alternate position and with phantom lines indicating the position of a part of the stop assembly which is out of view.

For the arrangement shown in the preferred embodiment, the piston and cylinder arrangement 142 is oriented such that, when the piston 155 is fully extended, the crank arm 141 orients the cam member 125 in a first position to support the stop arm 76 in proper position for engagement with a trolley dog 40, FIGS. 6 and 7. On the other hand, when the piston 155 has been retracted, FIG. 7, the crank arm 141 is positioned to orient the cam member 125 in a lower, substantially horizontal position permitting the stop arm 76 to lower, FIG. 2, out of possible engagement with a trolley dog 40. It is noted that the pivotal relationship between the cylinder 156 and ear 157, provided by axle 158, permits pivotal movement of the piston and cylinder arrangement 142 to accommodate arcuate motion of the crank arm 141 during actuation of the assembly 75.

Under certain circumstances it may be preferred not to have a requirement that pressure be maintained within the piston and cylinder arrangement 142 in order to retain the stop arm 76 in the first braking position. The trolley stop assembly 75 of the preferred embodiment includes means permitting retention of the stop arm 76 in the first position, even without having substantial pressure maintained in the piston and cylinder arrangement 142. This is perhaps best understood by reference to FIG. 5.

Preferably, cam member 125 is oriented such that when it is in the first position to lift the stop arm 76, it extends generally straight upward. Preferably, the lower cam surface 99 of the stop arm 76 includes a rest portion 165 thereon which extends generally horizontally when the stop arm 76 is in the first braking position. In the preferred embodiment, FIG. 5, the rest portion or shoulder 165 extends substantially horizontally at the point of engagement between the first end 127 of the cam member 125 and the lower cam surface 99 of the stop arm 76. Thus, at this extreme position the stop arm 76 is held upwardly by the cam member 125 which does not tend to pivot due to its substantially vertical extension and the engagement between the flat surface 130 of the cam 125 and the rest surface 165 of the stop arm 76. As a result, pressure may be taken off of the piston and cylinder arrangement 142 leaving the stop arm 76 retained in the upper braking position.

One of the major advantages of the present system will be understood by reference to FIG. 4, a fragmentary top plan view of the assembly 75, and FIG. 3, a cross-sectional view. Generally, with respect to a side 170 of the track 5, the trolley stop assembly 75 maintains a relatively low profile. That is, the assembly 75 does not have to jut substantially outwardly from underneath the track 5. Thus, it does not provide an inconvenient and potentially hazardous obstruction to workers passing by and near the side 170 of the conveyor system 1.

Further, the assembly 75 can be relatively easily mounted at almost any point along a conveyor system 1. Generally, FIG. 6, frame member 85 can be relatively easily mounted upon extensions 176 by means of bolts 177 or the like. Further, the assembly 75 is easily accessible for maintenance and repair, FIGS. 5 and 6.

Operation of the assembly 75 in cooperation with conveyor system 1 will be understood from the following:

Referring to FIGS. 1 and 2, generally a trolley 6 is conveyed along track 5 by means of engagement between a drive dog 45 and the trolley dog 40. When braking is not desired, the trolley stop assembly 75 is oriented as shown in FIG. 2 with the stop arm 76 lowered, the cam member 125 lowered, and the piston 155 retracted, FIG. 7.

When it is desired that a selected trolley be stopped by operation of the trolley stop assembly 75, means are operated to extend the piston 155, FIG. 6, pivoting the cam member 125 into upward projection, which will lift the stop arm 76, FIG. 5. The trolley dog 40 on the next trolley 6 traveling along the track 5 will be lifted by means of a camming interaction-type engagement with the stop arm 76. This will result in a lifting of the trolley dog 40, FIG. 5, until the trolley dog 40 disengages from the drive dog 45. Also, the abutment portion 105 of the stop arm 76 will engage the abutment portion 106 of the trolley dog 40, abruptly stopping the trolley 6.

In order to release an engaged trolley 6, FIG. 5, for travel along the track 5 by means of the next available drive dog 45, it is simply necessary to pivot the cam member 125 by retraction of the piston 155 to permit a lowering of the stop arm 76 into the orientation of FIG. 2. At this time, the trolley dog 40 will drop to its lower position for possible engagement by a drive dog 45.

Again, it is noted that when the cam member 125 is in the first position, projecting upwardly, the stop arm 76 rests thereon by means of the rest portion 165, in a manner retaining the engagement even if substantial pressure is taken off of the piston and cylinder arrangement 142.

It is noted that a trolley stop assembly utilizing similar principles may be adapted for use in an overhead power and free conveyor system; however, generally opposite pivoting of the stop arm 76 would be used. That is, generally the drive dogs of the system would be oriented above the trolley dogs and would extend downwardly. Typically, a camming motion downwardly of the trolley dog by the stop arm to force the trolley dog out of contact with the pusher dogs would lead to stopping. Again, the instant invention may be readily adapted to such an arrangement.

It is to be understood that while certain embodiments of the present invention have been illustrated and described herein, the invention is not to be limited to the specific forms or arrangement of parts herein described and shown.

What is claimed and desired to be secured by Letters Patent is as follows:

1. A trolley stop assembly for use in a trolley system including a mobile trolley with a depending, movable trolley dog engageable in a lower position by an upwardly extending drive dog of a trolley drive mechanism for movement of the trolley along a track, said trolley stop assembly comprising:

(a) a frame member;

(b) a stop arm pivotally mounted on said frame member, including a lower rest surface, and pivotable between a lower trolley engaged position and an upper trolley disengaging position to cause a trolley dog of a trolley to disengage from a drive dog of a trolley drive mechanism;

(c) a cam member pivotally mounted on said frame member, engaging said stop arm rest surface, and pivoted between a substantially vertical stop arm raising position to thereby urge said stop arm to said trolley disengaging position and a stop arm releasing position to thereby release said stop arm to said trolley engaged position;

(d) cam motor means connected to said cam member and selectively activated to pivot said cam member between said arm releasing position and said arm raising position;

(e) said cam member being configured to cooperate with said rest surface of said stop arm to provide stable support to said stop arm to thereby maintain said stop arm in said upper trolley disengaging position without said cam motor means being active; and (f) said stop arm, said cam member, and said cam motor means cooperating to position said stop arm in said lower trolley engaged position and to cause said stop arm to remain in said lower trolley engaged position without said cam motor means being active.

2. A trolley stop assembly for use in a trolley system including a mobile trolley with a depending, movable trolley dog engageable in a lower position by an upwardly extending drive dog of a trolley drive mechanism for movement of the trolley along a track, said trolley stop assembly comprising:

(a) a frame member;

(b) a stop arm pivotally mounted on said frame member, including a lower rest surface, and pivotable between a lower trolley engaged position and an upper trolley disengaging position to cause a trolley dog of a trolley to disengage from a drive dog of a trolley drive mechanism;

(c) a cam member pivotally mounted on said frame member, engaging said stop arm rest surface, and pivoted between a substantially vertical stop arm raising position to thereby urge said stop arm to said trolley disengaging position and a stop arm releasing position to thereby release said stop arm to said trolley engaged position;

(d) cam motor means connected to said cam member and selectively activated to pivot said cam member between said arm releasing position and said arm raising position;

(e) said cam member being configured to cooperate with said rest surface of said stop arm to provide stable support to said stop arm to thereby maintain said stop arm in one of said trolley engaged and disengaging positions without said cam motor means being active; and (f) said cam member including a cam end with a flat surface which is engaged by said rest surface of said stop arm when said cam member is in said substantially vertical stop arm raising position to maintain said stop arm in said trolley disengaging position without said cam motor means being active.

3. An assembly as set forth in claim 2 wherein:

(a) said cam member is positioned on a cam shaft pivotally mounted on said frame member; and (b) said motor means includes a linear motor connected by a cam crank to said cam shaft to pivot said cam member between said stop arm raising and releasing positions.

4. An assembly as set forth in claim 2 wherein:

(a) said cam member is positioned on a cam shaft pivotally mounted on said frame member; and (b) said motor means includes a double acting fluid cylinder connected by a cam crank to said cam shaft to pivot said cam member between said stop arm raising and releasing positions.

5. An assembly as set forth in claim 2 wherein:

(a) said stop arm is mounted on said frame member to pivot about a substantially horizontal stop arm axis which is substantially transverse to a track on which a trolley engageable with said stop arm moves.

6. An assembly as set forth in claim 2 wherein said stop arm includes:

(a) an abutment which engages a trolley dog of a trolley to stop said trolley in said trolley disengaging position of said stop arm.

7. A trolley stop assembly for use in an inverted power and free trolley system including a mobile trolley with a depending, movable trolley dog engageable in a lower position by an upwardly extending drive dog of a trolley drive mechanism for movement of the trolley along a track, said trolley stop assembly comprising:

(a) a frame member;

(b) a stop arm pivotally mounted on said frame member, including a lower rest surface, and pivotable between a lower trolley engaged position and an upper trolley disengaging position to cause a trolley dog of a trolley to disengage form a drive dog of a trolley drive mechanism;

(c) said stop arm being mounted on said frame member to pivot about a substantially horizontal stop arm axis which is substantially transverse to a track on which a trolley engageable with said stop arm moves;

(d) said stop arm including an abutment which engages a trolley dog of a trolley to stop said trolley in said trolley disengaging position of said stop arm;

(e) a cam member pivotally mounted on said frame member by a cam shaft, engaging said stop arm rest surface, and pivoted between a substantially vertical stop arm raising position to thereby urge said stop arm to said trolley disengaging position and a stop arm releasing position to thereby release said stop arm to said trolley engaged position;

(f) a cam linear motor connected to said cam member by a cam crank and selectively activated to pivot said cam member between said arm releasing position and said arm raising position;

(g) said cam member including a cam end with a flat surface to engage said rest surface of said stop arm to provide stable support to said stop arm to thereby maintain said stop arm said trolley disengaging position without said cam motor being active; and (h) said cam member engaging said rest surface of said stop arm to provide stable support to said stop arm in said trolley engaged position without cam motor being active.

8. An assembly as set forth in claim 7 wherein:

(a) said cam linear motor is a double acting fluid cylinder.

* * * * *